US010101687B2

(12) United States Patent
Oikawa et al.

(10) Patent No.: US 10,101,687 B2
(45) Date of Patent: Oct. 16, 2018

(54) DEVELOPING APPARATUS AND IMAGE FORMING APPARATUS HAVING SAME

(71) Applicant: S-Printing Solution Co., Ltd., Suwon-si (KR)

(72) Inventors: Mitsuru Oikawa, Seongnam-si (KR); Jin-hong Kim, Gwangmyeong-si (KR); Dae-ho Kim, Seoul (KR); Jun-hee Lee, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/325,883

(22) PCT Filed: Jul. 14, 2015

(86) PCT No.: PCT/KR2015/007284
§ 371 (c)(1),
(2) Date: Jan. 12, 2017

(87) PCT Pub. No.: WO2016/010333
PCT Pub. Date: Jan. 21, 2016

(65) Prior Publication Data

US 2017/0153578 A1 Jun. 1, 2017

(30) Foreign Application Priority Data

Jul. 14, 2014 (KR) ..... 10-2014-0088642

(51) Int. Cl.
*G03G 15/08* (2006.01)
*G03G 15/095* (2006.01)

(52) U.S. Cl.
CPC ..... *G03G 15/0891* (2013.01); *G03G 15/0865* (2013.01); *G03G 15/095* (2013.01);
(Continued)

(58) Field of Classification Search
CPC ..... G03G 15/0893; G03G 15/0877; G03G 15/0891; G03G 15/0822; G03G 2215/0822
See application file for complete search history.

(56) References Cited

U.S. PATENT DOCUMENTS 5,657,115 A 8/1997 Sugihara
6,266,504 B1 7/2001 Katoh
(Continued)

FOREIGN PATENT DOCUMENTS

JP 7-13420 1/1995
JP 7-244425 9/1995
(Continued)

OTHER PUBLICATIONS

International Search Report dated Nov. 24, 2015 in corresponding International Application No. PCT/KR2015/007284.
(Continued)

*Primary Examiner* — Walter L Lindsay, Jr.
*Assistant Examiner* — Jessica L Eley
(74) *Attorney, Agent, or Firm* — Staas & Halsey LLP

(57) ABSTRACT

A developing apparatus for an image forming apparatus comprises: a developing roller; a developing housing which rotatably supports the developing roller and receives a two-component developer; a first mixing member installed in the developing housing to mix the developer; and a second mixing member installed in the developing housing to be parallel to the first mixing member and adjacent to the developing roller, wherein the second mixing member comprises: a shaft; a spiral wing part formed along the shaft; and a plurality of ribs formed so as to protrude from the surface of the shaft.

15 Claims, 24 Drawing Sheets

(52) U.S. Cl.
CPC ..... *G03G 2215/0819* (2013.01); *G03G 2215/0827* (2013.01)

(56) References Cited

U.S. PATENT DOCUMENTS

| | | | | |
|---|---|---|---|---|
| 7,650,101 | B2 | 1/2010 | Hosokawa et al. | |
| 7,711,290 | B2 | 5/2010 | Lee et al. | |
| 9,152,085 | B2 | 10/2015 | Hayashi et al. | |
| 2007/0231015 | A1* | 10/2007 | Sakamaki ..... | G03G 15/0844 399/257 |
| 2010/0322675 | A1* | 12/2010 | Tsutsui ..... | G03G 15/0822 399/254 |
| 2012/0063813 | A1* | 3/2012 | Mihara ..... | G03G 15/0808 399/254 |

FOREIGN PATENT DOCUMENTS

| | | |
|---|---|---|
| JP | 2007-101928 | 4/2007 |
| JP | 2007-155869 | 6/2007 |
| JP | 2010-217226 | 9/2010 |
| JP | 2013-127566 | 6/2013 |
| KR | 1996-0018451 | 6/1996 |
| KR | 10-2008-0018704 | 2/2008 |

OTHER PUBLICATIONS

Written Opinion of the International Search Authority dated Nov. 24, 2015 in corresponding International Application No. PCT/KR2015/007284.

* cited by examiner

DEVELOPING APPARATUS AND IMAGE FORMING APPARATUS HAVING SAME

CROSS-REFERENCE TO RELATED APPLICATIONS

This application is a U.S. National Stage Application, which claims the benefit under 35 U.S.C. § 371 of PCT International Patent Application No. PCT/KR2015/007284, filed Jul. 14, 2015, which claims the foreign priority benefit under 35 U.S.C. § 119 of Korean Patent Application No. 10-2014-0088642, filed Jul. 14, 2014, the contents of which are incorporated herein by reference.

TECHNICAL FIELD

The present invention relates to a developing apparatus for an image forming apparatus. More particularly, the present invention relates to a developing apparatus for an image forming apparatus using two-component developer consisting of toner and carrier, and an image forming apparatus having the same.

BACKGROUND ART

An electrophotographic image forming apparatus develops an electrostatic latent image formed on an image carrier using developer, and transfers the developed image onto a print medium, thereby forming a predetermined image on the print medium.

Developing apparatuses using two-component developer including toner and carrier as the developer for developing the electrostatic latent image are used.

Such a developing apparatus includes a first mixing member for mixing the developer and a second mixing member for supplying the developer to the image carrier. The developing apparatus is required so that the second mixing member stably supplies the developer to a developing roller. For this it is good that a height of the developer in a second developer area in which the second mixing member is disposed is maintained higher than a height of the developer in a first developer area in which the first mixing member is disposed.

When the height of the developer in the second developer area is low, the second mixing member cannot supply a sufficient amount of the developer to the developing roller. At this time, as illustrated in FIG. 1, an image density deviation of a vertical direction called as auger mark 110 is generated in a period of a pitch p of the second mixing member 100.

Also, when the height of the developer in the second developer area is too high, the developer supplied from the second mixing member to the developing roller is moved with rotation of the developing roller, separated from the developing roller, and falls toward the second mixing member. However, before the developer is mixed by the second mixing member, some developer is reattached to the developing roller. When this phenomenon occurs, replaceability of the developer is deteriorated. In the case in which the replaceability of the developer is deteriorated, when documents of high coverage are continuously printed, the image density is gradually lowered.

In order to prevent generation of the auger mark, a method of increasing a diameter of a shaft of the second mixing member than a diameter of a shaft of the first mixing member has been proposed. However, if the diameter of the shaft of the second mixing member is increased, the height of the developer of the second developer area is maintained high, but mixability of the developer by the second mixing member is weakened. When the second mixing member does not sufficiently mix the developer, scattering of the developer occurs.

Recently, use of an auto developer refill developing apparatus which supplies the developer with toner to which a small amount of carrier is added and discharges surplus developer is increasing. The auto developer refill developing apparatus is mainly configured so that a developer discharge port is provided at an end portion of the mixing member, and when the height of the developer in the vicinity of the developer discharge port is above a certain value, the developer overflows to be discharged.

The height of the developer is changed by the rotational speed of the mixing member. By the way, a printing speed may be lowered in accordance with printing conditions. For example, when printing a high-resolution image, or when printing a thick paper, the printing speed is lowered. At this time, the printing speed is often approximately half of the normal speed (maximum speed). Accordingly, the low-speed is generally referred to as a half speed.

When the printing speed is changed as described above, the rotational speed of the mixing member of the developing apparatus also is changed according to the printing speed. At this time, the change in the height of the developer is very large. As fast as the rotational speed of the mixing member of the developing apparatus is, the height of the developer is increased so that a lot of developer is discharged. However, when the rotational speed of the mixing member is slow, the height of the developer is lowered so that the developer is not discharged. In other words, when the rotational speed of the mixing member is fast, the amount of developer decreases, and when the rotational speed of the mixing member is slow, the amount of developer increases.

When the printing speed is repeatedly switched between the maximum speed and the half speed, a case in which the amount of developer is small and the height of the developer is low and a case in which the amount of developer is large and the height of the developer is high occur. When the height of the developer is low in the second mixing member including the second mixing member and the developing roller, the image density deviation called as auger mark is generated. On the other hand, when the height of the developer is high, the replaceability of the developer is deteriorated so that the image density is lowered. Accordingly, in the auto developer refill developing apparatus, it is preferable that even when the printing speed is changed, the amount of developer is not changed.

DISCLOSURE

Technical Problem

The present disclosure has been developed in order to overcome the above drawbacks and other problems associated with the conventional arrangement. An aspect of the present disclosure relates to a developing apparatus that can maintain a height of developer in a second developer area including a second mixing member and a developing roller constant and can improve developer mixability of the second mixing member, and an image forming apparatus having the same.

Also, another aspect of the present disclosure relates to a developing apparatus in which even when a printing speed is changed, change in an amount of developer is small, and image defects such as image density deviation, image density decrease and the like do not occur, and an image forming apparatus having the same.

Technical Solution

A developing apparatus for an image forming apparatus according to an aspect of the present disclosure may include a developing roller; a developing housing which rotatably supports the developing roller and receives two-component developer; a first mixing member disposed in the developing housing to mix the developer; and a second mixing member disposed in the developing housing to be parallel to the first mixing member and adjacent to the developing roller, wherein the second mixing member may include a shaft, a spiral wing part formed along the shaft, and a plurality of ribs formed so as to protrude from a surface of the shaft.

The plurality of ribs may be formed at predetermined intervals along an outer circumferential surface of the shaft.

Each of the plurality of ribs may be continuously formed in a longitudinal direction of the shaft.

The number of the plurality of ribs may satisfy a following formula.

$$4 \leq n \leq 8$$

wherein, n is the number of ribs.

The surface of the shaft may be exposed between the plurality of ribs.

The first mixing member may include a first shaft and a first spiral wing part formed along the first shaft, and each of the plurality of ribs may be formed to satisfy a following formula.

$$Di2+2h>Di1$$

wherein, Di1 is an inner diameter of the first mixing member, Di2 is an inner diameter of the second mixing member, and h is a height of the plurality of ribs protruding from the shaft of the second mixing member.

Each of the plurality of ribs may be formed to satisfy a following formula.

$$0.5\text{ mm} \leq h \leq (Do2-Di2)/4\text{ mm}$$

wherein, Do2 is an outer diameter of the second mixing member, Di2 is an inner diameter of the second mixing member, and h is a height of the plurality of ribs protruding from the shaft of the second mixing member.

Each of the plurality of ribs may be formed to include an inclined plane, a height of the inclined plane of a downstream side based on a rotational direction of the second mixing member may be high, and a height of the inclined plane of a upstream side may be low.

Each of the plurality of ribs may further include a vertical plane vertically expended from the surface of the shaft, and a connecting plane connecting the vertical plane and the inclined plane.

The inclined plane of each of the plurality of ribs may include a concave groove or a convex protrusion.

The inclined plane of each of the plurality of ribs may be formed in a concave curved line or a convex curved line.

Each of the plurality of ribs may be formed to have a cross-section of any one shape of rectangle, triangle, and semicircle.

The developing housing may be provided with a developer discharge port which is formed in a downstream of a developer conveying direction of the first mixing member and discharges excess developer outside the developing housing.

The developing housing may be provided with a developer supply port which is formed in an upstream of the developer conveying direction of the first mixing member and supplies new developer to an inside of the developing housing.

The developer may include toner and carrier.

An image forming apparatus according to another aspect may include an image carrier on which an electrostatic latent image is formed; and a developing apparatus including one of the above-described features to supply developer to the image carrier.

BEST MODE

Hereinafter, embodiments of a developing apparatus according to the present disclosure and an image forming apparatus having the same will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

Figure 1:
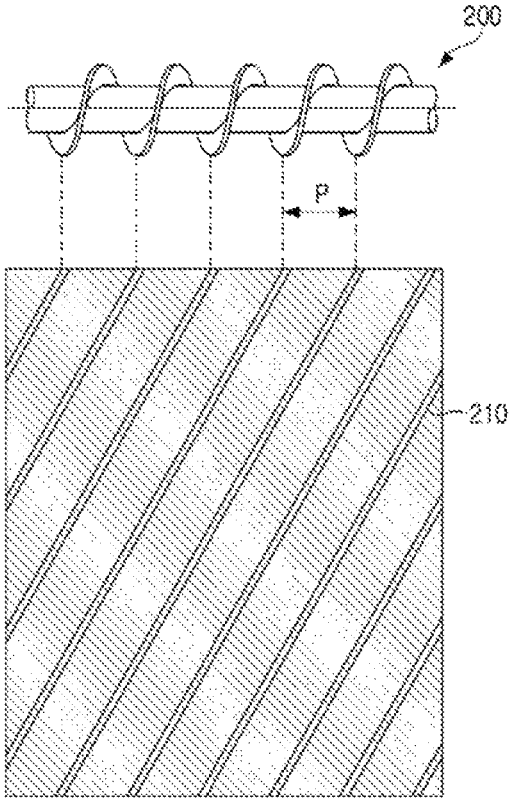
FIG. 1 is a view illustrating auger marks generated by an mixing member of a conventional developing apparatus.
Figure 2:
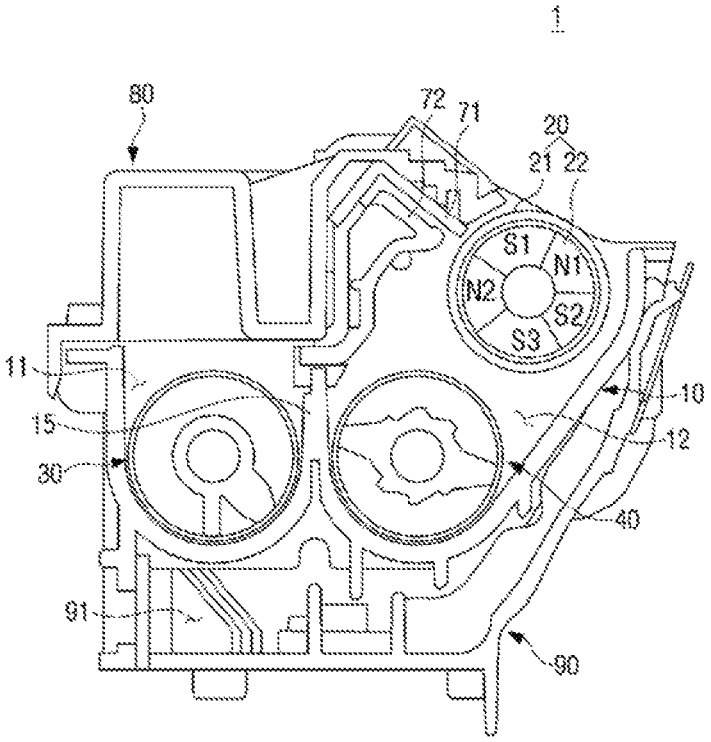
FIG. 2 is a cross-sectional view illustrating a developing apparatus according to an embodiment of the present disclosure.
Figure 3:
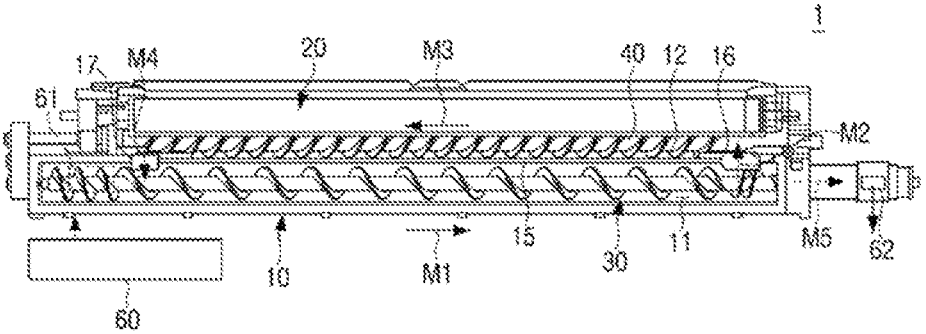
FIG. 3 is a front view illustrating a developing apparatus according to an embodiment of the present disclosure without a cover.
Figure 4:
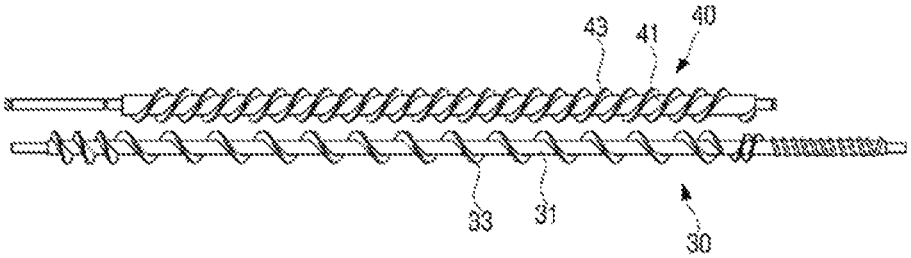
FIG. 4 is a perspective view illustrating a first mixing member and a second mixing member of the developing apparatus of FIG. 3.
Figure 5:
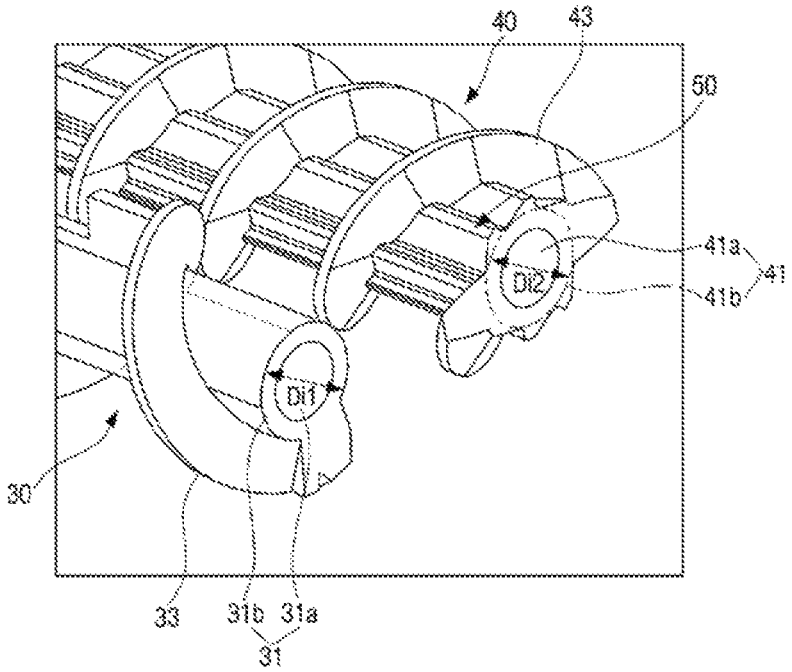
FIG. 5 is a sectional perspective view illustrating a first mixing member and a second mixing member of a developing apparatus according to an embodiment of the present disclosure.

FIG. 2 is a cross-sectional view illustrating a developing apparatus according to an embodiment of the present disclosure, and FIG. 3 is a front view illustrating a developing apparatus according to an embodiment of the present disclosure without a cover. FIG. 4 is a perspective view illustrating a first mixing member and a second mixing member of the developing apparatus of FIG. 3, and FIG. 5 is a sectional perspective view illustrating a first mixing member and a second mixing member of a developing apparatus according to an embodiment of the present disclosure.

Referring to FIGS. 2 to 5, a developing apparatus 1 for an image forming apparatus according to an embodiment of the present disclosure may include a developing housing 10, a developing roller 20, a first mixing member 30, a second mixing member 40, and a upper cover 80.

The developing housing 10 rotatably supports the developing roller 20, and includes a space to accommodate developer. The developer accommodating space includes a first developer area 11 in which the first mixing member 30 is rotatably disposed and a second developer area 12 in which the second mixing member 40 is rotatably disposed. The second developer area 12 is adjacent to the developing roller 20. A partition wall 15 exists between the first developer area 11 and the second developer area 12, and is formed in parallel to the first and second mixing members 30 and 40. The partition wall 15 is provided with two openings 16 and 17 that allows the developer in the first developer area 11 and the second developer area 12 to be circulated. Accordingly, when the first mixing member 30 and the second mixing member 40 rotate, as indicated by arrows M1, M2, M3, and M4 in FIG. 3, the developer is circulated between the first developer area 11 and the second developer area 12 through the two openings 16 and 17 provided in the partition wall 15. The developer uses two-component developer including toner and carrier. The carrier is to carry the toner, and is formed from a magnetic material that can be attached to a magnet such as iron powder.

The developing housing 10 is provided with a first regulating member 71 which faces the developing roller 20 and regulates a thickness of the developer layer attached to the developing roller 20. The first regulating member 71 may be a doctor blade.

Also, a second regulating member 72 is disposed between the partition wall 15 and the first regulating member 71 of the developing housing 10. The second regulating member 72 is located above the second mixing member 40, and regulates the amount of the developer attached to the developing roller 20, thereby dropping the developer over the second mixing member 40.

A developer supply port 61 is provided adjacent to an end of the first developer area 11 of the developing housing 10, in detail, the end of the first mixing member 30 to the upstream side of the developer conveying direction (arrow M1) of the first mixing member 30. A developer discharge port 62 is provided adjacent to the other end of the first mixing member 30 to the downstream side thereof. The developer supply port 61 is connected to a developer supply unit 60 in which toner and a small amount of carrier are stored, thereby supplying the developer containing toner and carrier to the end of the first developer area 11. The toner is consumed by the development, but the added carrier becomes in excess, thereby being discharged to the outside of the developing housing 10 through the developer discharge port 62 provided in the other end of the first developer area 11. Since the present embodiment relates to the auto developer refill developing apparatus which automatically supplies the developer with toner to which a small amount of carrier is added and automatically discharges the excess developer, the developing housing 10 is provided with the developer supply port 61 and the developer discharge port 62. However, general developing apparatuses (not illustrated) may not be provided with the developer supply port 61 and the developer discharge port 62.

The developing roller 20 develops the electrostatic latent image formed on the image carrier 120 into a developer image by moving the developer in the second developer area 12 to the image carrier 120. The developing roller 20 includes a developing sleeve 21 and a magnet roller 22 disposed inside the developing sleeve 21. The developing sleeve 21 is formed in a hollow cylindrical shape, and is disposed to rotate about the developing housing 10. The magnet roller 22 is disposed concentrically with the developing sleeve 21, and is fixed to the developing housing 10 not to rotate. The magnet roller 22 is formed to include a plurality of magnetic poles S1, S3, S3, N1, and N2 so as to move the developer in the second developer area 12 to the image carrier 120. An example of arrangement of the plurality of magnetic poles S1, S3, S3, N1, and N2 configuring the magnet roller 22 is illustrated in FIG. 6.

Figure 6:
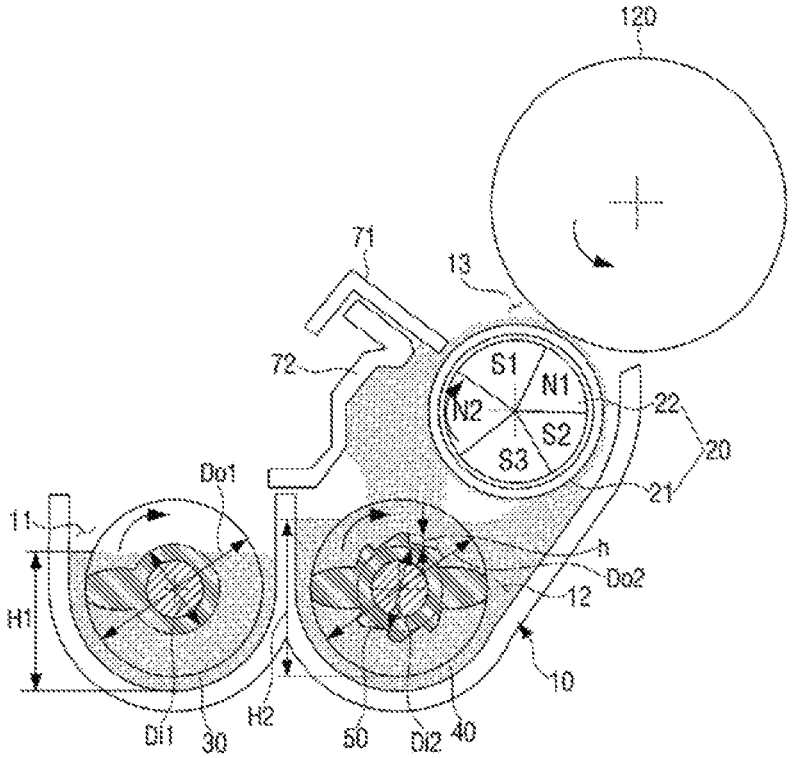
FIG. 6 is a cross-sectional view schematically illustrating a developing apparatus according to an embodiment of the present disclosure.

Referring to FIG. 6, the plurality of magnetic poles of the magnet roller 22 may include a catch pole S3, a regulating pole N2, a main pole S1, a conveying pole N1, and a separating pole S2. The catch pole S3 is located adjacent to the second mixing member 40, and renders the developer in the second developer area 12 to be attached onto the developing sleeve 21. The regulating pole N2 is formed of a magnet having a polarity opposite to the catch pole S3, is disposed adjacent to the first regulating member 71 at one side of the catch pole S3, and allows the developer attached to the developing sleeve 21 to pass by the first regulating member 71. The main pole S1 is formed of a magnet having the same polarity as the catch pole S3. The main pole S1 is disposed adjacent to the image carrier 120 at one side of the regulating pole N2, and causes the toner of the developer passing through the regulating pole N2 to be moved to the image carrier 120. The conveying pole N1 is formed of a magnet having a polarity opposite to the catch pole S3, is disposed at one side of the main pole S1, and causes the developer passing through a developing region 13 to be moved to the separating pole S2. The separating pole S2 is disposed at one side of the catch pole S3, and is formed of a magnet having the same polarity as the catch pole S3. Accordingly, the developer which is conveyed to the separating pole S2 by the conveying pole N1 is separated from the developing sleeve 21 by the repulsion of the catch pole S3 and the separating pole S2. In FIG. 6, a case that the catch pole S3 is an S pole has been illustrated and described as one example. However, although not illustrated, the catch pole may be formed as an N pole. At this time, polarities of the other poles are changed to correspond to the catch pole.

Referring back to FIG. 2, the upper cover 80 is provided to cover the first mixing member 30, the second mixing member 40, and the developing roller 20 above the developing housing 10. At this time, the upper cover 80 covers a portion of the developing roller 20 so that another portion of the developing roller 20 is exposed to face the image carrier 120. The upper cover 80 may be provided with a developer supply unit 60 for supplying the developer to the developer supply port 61.

The lower cover 90 is disposed below the developing housing 10, and may be provided with a waste toner receiving portion 91 for receiving the developer discharged through the developer discharge port 62.

The first mixing member 30 is rotatably disposed in the first developer area 11 of the developing housing 10. The first mixing member 30 includes a first shaft 31 and a first wing part 33. The first shaft 31 is supported so that the first mixing member 30 rotates with respect to the developing housing 10. The first wing part 33 is formed in a spiral shape along the first shaft 31. In detail, the first wing part 33 may be formed in a form that a thin strip is disposed in a spiral shape on the outer circumferential surface of the first shaft 31. Accordingly, when the first mixing member 30 is rotated, the developer in the first developer area 11 is mixed and conveyed in the axial direction of the first mixing member 30. On the other hand, the first shaft 31 may be formed in a double shaft. In this case, an inner shaft 31*a* may be formed of a high strength metal, and an outer shaft 31*b* may be formed of a material such as plastic so that the outer shaft 31*b* may be molded integrally with the first wing part 33.

The second mixing member 40 is rotatably disposed in the second developer area 12 of the developing housing 10. In detail, the second mixing member 40 is disposed parallel to the first mixing member 30 and adjacent to the developing roller 20 in the developing housing 10. The second mixing member 40 may include a second shaft 41, a second wing part 43, and a plurality of ribs 50. The second shaft 41 is supported so that the second mixing member 40 rotates with respect to the developing housing 10. The second wing part 43 is formed in a spiral shape along the second shaft 41. In detail, the second wing part 43 may be formed in a form that a thin strip is disposed in a spiral shape on the outer circumferential surface of the second shaft 41. At this time, an inner diameter Di2 and an outer diameter Do2 of the second mixing member 40 may be formed to be the same as the inner diameter Di2 and the outer diameter Do1 of the first mixing member 30. Here, the inner diameter Di2 of the second mixing member 40 refers to an outer diameter of the second shaft 41, and the outer diameter Do2 of the second mixing member 40 refers to an outer diameter of the second wing part 43. Also, the inner diameter Di1 of the first mixing member 30 refers to an outer diameter of the first shaft 31, and the outer diameter Do1 of the first mixing member 30 refers to an outer diameter of the first wing part 33. On the other hand, the second shaft 41 may be formed in a double shaft. In this case, an inner shaft 41*a* may be formed of a high strength material such as metal, and an outer shaft 41*b* may be formed of an easily molded material such as plastic so that the outer shaft 41*b* may be molded integrally with the second wing part 43 and the plurality of ribs 50.

The plurality of ribs 50 are formed to protrude from the outer circumferential surface of the second shaft 41. Also, each of the plurality of ribs 50 may be formed parallel to the axial direction of the second shaft 41. Due to the plurality of ribs 50, the conveying speed of the developer by the second mixing member 40 is decreased, the mixability is improved, and the height H2 of developer in the second developer area 12 becomes higher than the height H1 of developer in the first developer area 11 in which the first mixing member 30 is disposed. Here, the height H1 or H2 of developer refers to a height from a bottom surface of the first developer area 11 or the second developer area 12 to the top of the developer in the first developer area 11 or the second developer area 12. The volume of the developer accommodated in the first developer area 11 or the second developer area 12 changes in accordance with the change in the height H1 or H2 of the developer. In other words, if the height H1 and H2 of the developer is high, the volume of the developer occupying the developer areas 11 and 12 becomes large. If the height H1 and H2 of the developer is low, the volume of the developer occupying the developer area 11 and 12 becomes small.

To this effect, the inner diameter Di1 of the first mixing member 30, the inner diameter Di2 of the second mixing member 40, and the height h of the rib 50 may satisfy the following relationship.

$$Di1 < Di2 + 2h$$

Here, Di is the inner diameter of the first mixing member 30, Di2 is the inner diameter of the second mixing member 40, and h is a height of the rib protruding from the second shaft 41 of the second mixing member 40. Also, a unit of each of the Di1, Di2, and his mm.

When the height H1 of developer in the first developer area 11 is low, contact between the developer and the first wing part 33 of the first mixing member 30 is increased so that the mixability of the developer is increased. Also, if the developer supply unit 60 is provided near the end of the first mixing member 30 to the upstream side of the developer conveying direction M1 in the first developer area 11, the mixability of the developer supplied from the developer supply unit 60 is enhanced.

When the height H2 of developer in the second developer area 12 is high, the developer supply to the developing roller 20 is stabilized so that the amount of the developer regulated by the first regulating member 71 is stable, thereby obtaining a uniform image density.

Figure 7A:
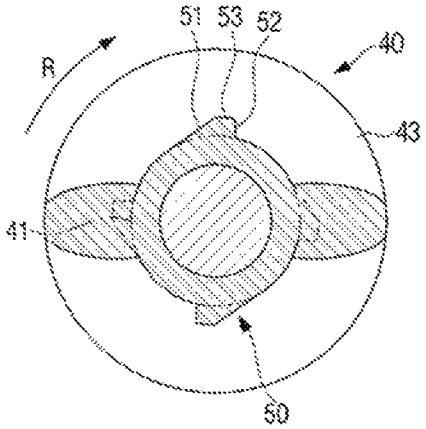
FIGS. 7*a* to 7*c* are cross-sectional views illustrating a plurality of ribs of a second mixing member used in a developing apparatus according to an embodiment of the present disclosure.
Figure 7B:
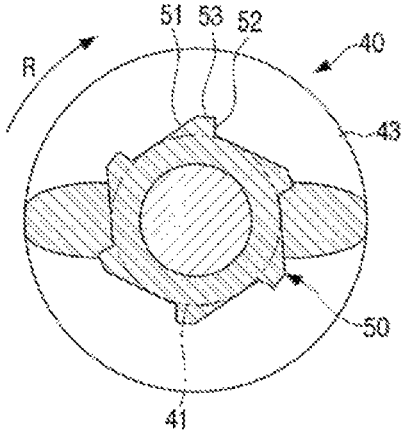
Figure 7C:
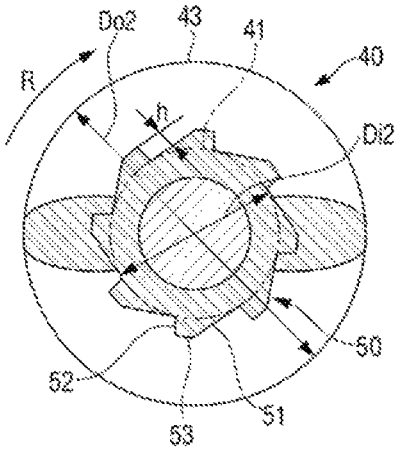

The number of the plurality of ribs 50 formed in the second mixing member 40 may be in a range of 4 to 8. FIG. 7*a* illustrates a case that the number of the ribs 50 is four, FIG. 7*b* illustrates a case that the number of the ribs 50 is six, and FIG. 7*c* illustrates a case that the number of the ribs 50 is eight. If the number of the ribs 50 is less than four, difference in developer density between a portion in which there is bounce of the developer by the ribs 50 and a portion in which there is not the bounce of the developer by the ribs 50 becomes large so that image density deviation may easily occur. If the number of the ribs 50 is more than eight, a space between the rib 50 and the rib 50 is narrow so that the effect of the developer bounce by the ribs 50 is reduced.

Also, the height h of the rib 50 formed on the second mixing member 40 may satisfy the following condition.

$$0.5\ \text{mm} \le h = (Do2 - Di2)/4\ \text{mm}$$

Here, Do2 is the outer diameter of the second mixing member 40, Di2 is the inner diameter of the second mixing member 40, and h is the height of each of the plurality of ribs 50 protruding from the surface of the second shaft 41 of the second mixing member 40.

It is preferable that the height h of the ribs 50 of the second mixing member 40 is in the range of 1 mm to 2 mm among the above-described conditions. If the height h of the rib 50 is less than 0.5 mm, the developer bounce effect by the ribs 50 is insufficient. If the height h of the rib 50 is over (the outer diameter of the second mixing member−the inner diameter of the second mixing member)/4, the developer bounce effect by the ribs 50 is increased so that a possibility that a rib mark occurs is increased. Here, the rib mark refers to the image density deviation that is generated in the vertical direction with respect to an advancing direction of the print medium by the density difference of the developer between the portion in which there is the bounce of the developer by the ribs 50 and the portion in which there is not the bounce of the developer by the ribs 50.

The plurality of ribs 50 of the second mixing member 40 as described above may be formed by a predetermined interval on the outer circumferential surface of the second shaft 41, and may extend in the longitudinal direction of the second shaft 41, respectively. Accordingly, as illustrated in FIG. 5, the plurality of ribs 50 may be formed on the outer circumferential surface of the second shaft 41 between the second wing parts 43 in the longitudinal direction of the second shaft 41. Alternatively, the second wing part 43 may be formed on the second shaft 41 in the form that the second wing part 43 cuts the plurality of ribs 50 formed on the outer circumferential surface of the second shaft 41 in the longitudinal direction.

The plurality of ribs 50 formed on the second mixing member 40 may be formed to have a variety of cross-sectional shapes.

FIGS. 7*a*, 7*b*, and 7*c* illustrate cases in which the cross-section of rib is a trapezoidal shape. At this time, one side of the rib 50 is formed in a vertical plane 52 that is extended substantially perpendicularly from the outer circumferential surface of the second shaft 41, and the other side of the rib 50 is formed in an inclined plane 51 that is inclined with respect to the outer circumferential surface of the second shaft 41. At this time, the inclined plane 51 is formed to be inclined upward toward the downstream side based on the rotational direction (arrow R direction) of the second mixing member 40. In detail, the inclined plane 51 is formed so that the height of the downstream side is higher than the height of the upstream side based on the rotational direction R of the second mixing member 40. Also, a connecting plane 53 is formed between the vertical plane 52 and the inclined plane 51. The connecting plane 53 may be formed to be substantially perpendicular to the vertical plane 52. As another example, the vertical plane 52 of the rib 50 may be formed in an inclined plane having a greater slope than the above-described inclined plane 51. At this time, the inclined plane is inclined downward toward the downstream side of the rotational direction R of the second mixing member 40, as opposed to the inclination of the above-described inclined plane 51.

In the case in which the ribs 50 as illustrated in FIG. 7*c* are formed on the second mixing member 40, when the developing roller 20 rotates at the maximum speed, the developer bounce effect by the ribs 50 is large, and the conveying speed of the developer is lowered so that the height H2 of the developer is increased in the second developer area 12. At this time, since the height H1 of the developer in the first developer area 11 is relatively decreased, it is difficult that surplus developer is discharged through the developer discharge port 62. When the developing roller 20 rotates at the half speed, the developer bounce effect by the ribs 50 of the second mixing member 40 is small, and the conveying speed of the developer is increased so that the height H2 of the developer is decreased in the second developer area 12. At this time, since the height H1 of the developer in the first developer area 11 is relatively increased, it is easy that the surplus developer is discharged through the developer discharge port 62. In general, at the maximum speed the amount of the developer is small, and at the half speed, the amount of the developer is increased. However, when the plurality of ribs 50 are formed on the second mixing member 40, the amount of the developer is increased at the maximum speed, and the amount of the developer is reduced at the half speed so that the change in the developer amount at the maximum speed and at the half speed is reduced.

FIGS. 8*a*, 8*b*, 8*c*, and 8*d* are cross-sectional views illustrating various variations of the plurality of ribs illustrated in FIG. 7*c*.

Figure 8A:
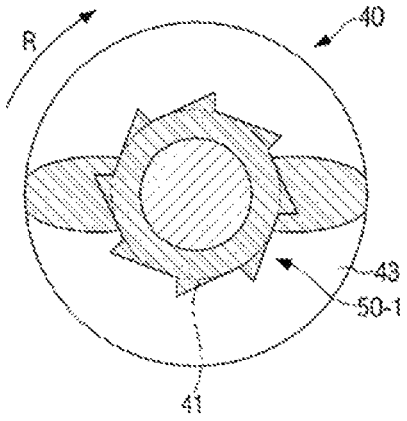
FIGS. 8*a* to 8*d* are cross-sectional views illustrating variations of the plurality of ribs of the second mixing member of FIG. 7*c;*

The cross-section of each of the plurality of ribs 50-1 as illustrated in FIG. 8*a* is different from the cross-section of each of the plurality of ribs 50 as illustrated in FIG. 7*c* in that there is no connecting plane 53. When the cross-section of the rib is formed not to have the connecting plane 53 by intersecting the vertical plane 52 and the inclined plane 51 of the rib 50 as illustrated in FIG. 7*c* with each other, the cross-section of the rib 50-1 of FIG. 8*a* may be formed. Accordingly, the ribs 50-1 of FIG. 8*a* have a cross-section of saw-tooth shape.

Figure 8B:
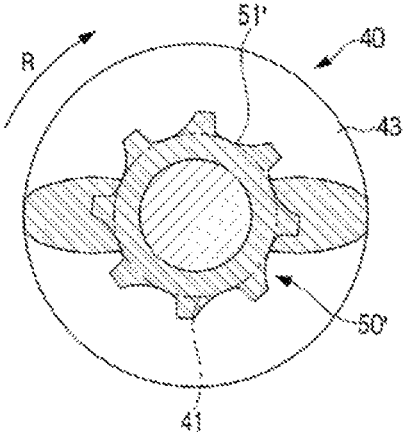
Figure 8C:
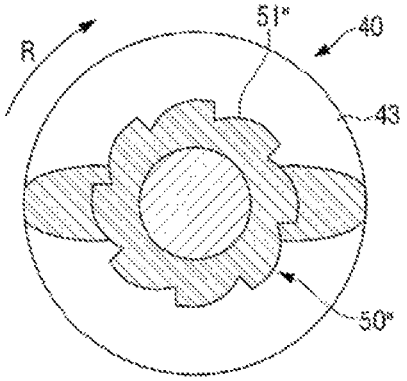

The cross-section of each of the plurality of ribs 50' and 50" as illustrated in FIGS. 8*b* and 8*c* is different from the cross-section of each of the plurality of ribs 50 as illustrated in FIG. 7*c* in the shape of the inclined plane 51. The inclined plane 51' of rib 51' of FIG. 8*b* is formed in a concave curved surface, and the inclined plane 51" of rib 51" of FIG. 8*c* is formed in a convex curved surface. FIGS. 8*b* and 8*c* show a case that the entire inclined plane 51' and 51" of the rib 50' and 50" is formed in a concave curved surface or in a convex curved surface. However, as another example, the inclined plane 51 of the rib 50 may be provided with a concave groove or a convex protrusion.

Figure 8D:
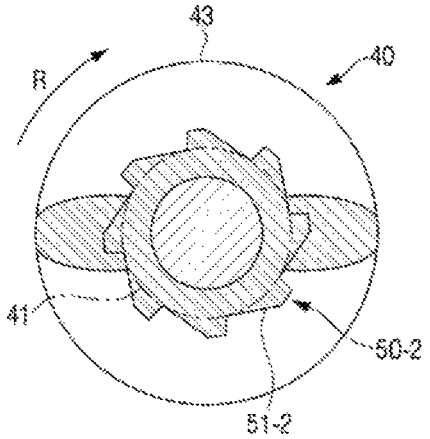

The cross-section of each of the plurality of ribs 50-2 as illustrated in FIG. 8*d* is different from the cross-section of each of the plurality of ribs 50 as illustrated in FIG. 7*c* in that the inclination direction of the inclined plane 51 is opposed to. That the cross-section of each of the plurality of ribs 50-2 as illustrated in FIG. 8*d* has the vertical plane 52 and the connecting plane 53 is the same as the cross-section of each of the plurality of ribs 50 as illustrated in FIG. 7*c*. In other words, the inclined plane 51-2 is formed to be inclined downward toward the downstream side of the rotational direction R of the second mixing member 40.

The plurality of ribs 50, 50-1, 50', 50", and 50-2 formed on the second mixing member 40 as illustrated in FIGS. 7*a* to 8*d* are formed so that the outer surface of the second shaft 41 is not exposed. For example, referring to the plurality of ribs 50 as illustrated in FIG. 7, the plurality of ribs 50 are formed so that the lower end of the vertical plane 52 of one of the plurality of ribs 50 is connected to the lower end of the inclined plane 51 of the next rib 50. Accordingly, the outer surface of the second shaft 41 on which the plurality of ribs 50 are formed is not exposed.

However, as another example, the plurality of ribs 50 may be formed so that the outer surface of the second shaft 41 is exposed between the pluralities of ribs 50.

FIGS. 9*a*, 9*b*, 9*c*, 9*d*, 9*e*, and 9*f* are cross-sectional views illustrating various examples of a plurality of ribs of a second mixing member 40 formed so that the outer surface of the second shaft 41 is exposed between the plurality of ribs.

Figure 9A:
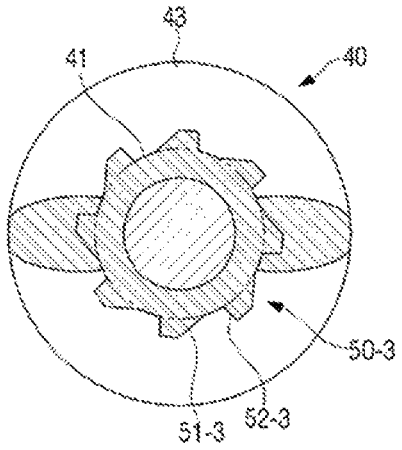
FIGS. 9*a* to 9*f* are cross-sectional views illustrating other examples of a plurality of ribs of a second mixing member used in a developing apparatus according to an embodiment of the present disclosure.

FIG. 9*a* shows a structure of the plurality of ribs 50-3 in that the cross-section of each of the plurality of ribs 50-3 is a trapezoidal shape similar to each of the plurality of ribs 50 as illustrated in FIG. 7*c*, and the lower end of the inclined plane 51-3 of the rib 50-3 is spaced apart from the lower end of the vertical plane 52-3 of an adjacent rib 50-3 so that the surface of the second shaft 41 is exposed.

Figure 9B:
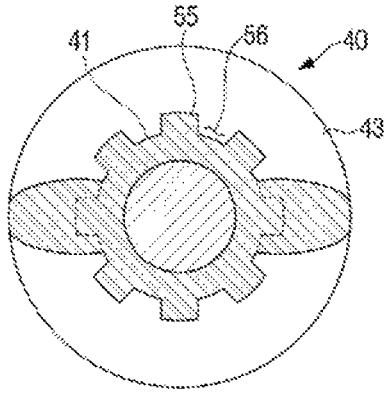

FIG. 9*b* shows a case in which the cross-section of each of the plurality of ribs 55 is a rectangular shape. Accordingly, there are spaces 56 in which the surface of the second shaft 41 are exposed between the pluralities of ribs 55 of the second mixing member 40.

Figure 9C:
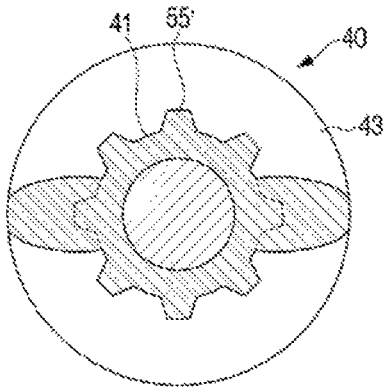

FIG. 9*c* shows a case in which the cross-section of each of the plurality of ribs 55' is an isosceles trapezoidal shape. Accordingly, there are spaces in which the surface of the second shaft 41 are exposed between the pluralities of ribs 55' of the second mixing member 40.

Figure 9D:
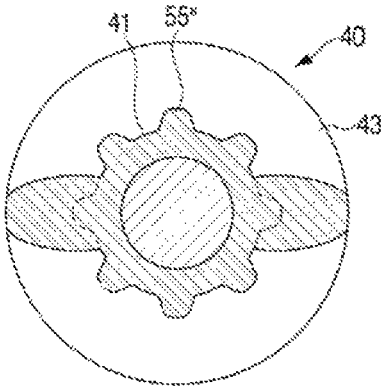

FIG. 9*d* shows a case in which the ribs 55" are formed by performing a round processing with respect to edges of the plurality of ribs 55' having the cross-section of an isosceles trapezoid of FIG. 9*c*. In this case, in the same manner as the plurality of ribs 55' of FIG. 9*c*, the second mixing member 40 is provided with spaces in which the surface of the second shaft 41 is exposed.

Figure 9E:
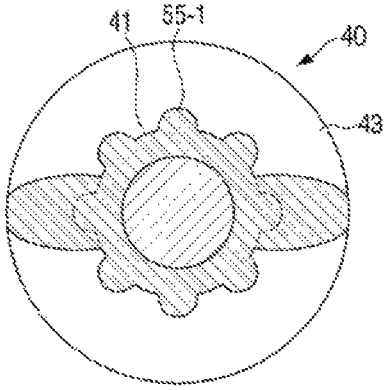

FIG. 9*e* shows a case in which the cross-section of each of the plurality of ribs 55-1 is a semicircle. Accordingly, the surface of the second shaft 41 is exposed in spaces between the pluralities of ribs 55-1 of the second mixing member 40.

Figure 9F:
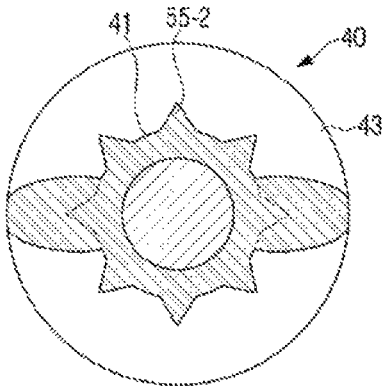

FIG. 9*f* shows a case in which the cross-section of each of the plurality of ribs 55-2 is a triangle. Accordingly, the surface of the second shaft 41 is exposed in spaces between the pluralities of ribs 55-2 of the second mixing member 40.

In the above description, the plurality of ribs 50 are formed continuously without interruption between the second wing part 43 in the axial direction of the second shaft 41 on the surface of the second shaft 41 of the second mixing member 40. However, as another example, the plurality of ribs 50 may be formed in the form broken in the axial direction of the second shaft 41.

Figure 10:
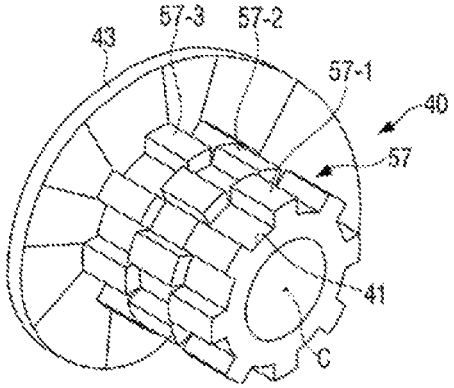
FIG. 10 is a cross-sectional view illustrating still other example of a plurality of ribs of a second mixing member used in a developing apparatus according to an embodiment of the present disclosure.

FIG. 10 shows a case in which the plurality of ribs 57 are formed in the form broken in the axial direction of the second shaft 41. FIG. 10 is a partial perspective view illustrating a portion of the second shaft 41 and the second wing part 43 of the second mixing member 40.

Referring to FIG. 10, the plurality of ribs 57 formed on the second mixing member 40 have a cross-section of a rectangular shape, and eight ribs 57 are formed on the surface of the second shaft 41 in the circumferential direction. Also, three lines of ribs 57-1, 57-2, and 57-3 formed in the longitudinal direction of the second shaft 41. The ribs 57-2 located at the middle are formed to be rotated a predetermined angle with respect to the ribs 57-1 and 57-3 located on both sides based on the central axis C of the second shaft 41. In FIG. 10, the ribs 57-2 located at the middle are formed to face the spaces of the ribs 57-1 and 57-3 located on both sides in which the second shaft 41 is exposed.

As one example, FIG. 10 has been described the case in which the cross-sections of the plurality of ribs 57 are a rectangular; however, the structure of the ribs 57 as illustrated in FIG. 10 is not limited thereto. Also, the plurality of ribs having the cross-section as illustrated in FIGS. 9*a* to 9*f* may be formed in the same structure as that of FIG. 10.

Hereinafter, operation of a developing apparatus according to an embodiment of the present disclosure will be described in detail with reference to FIGS. 2, 3, and 11.

Figure 11:
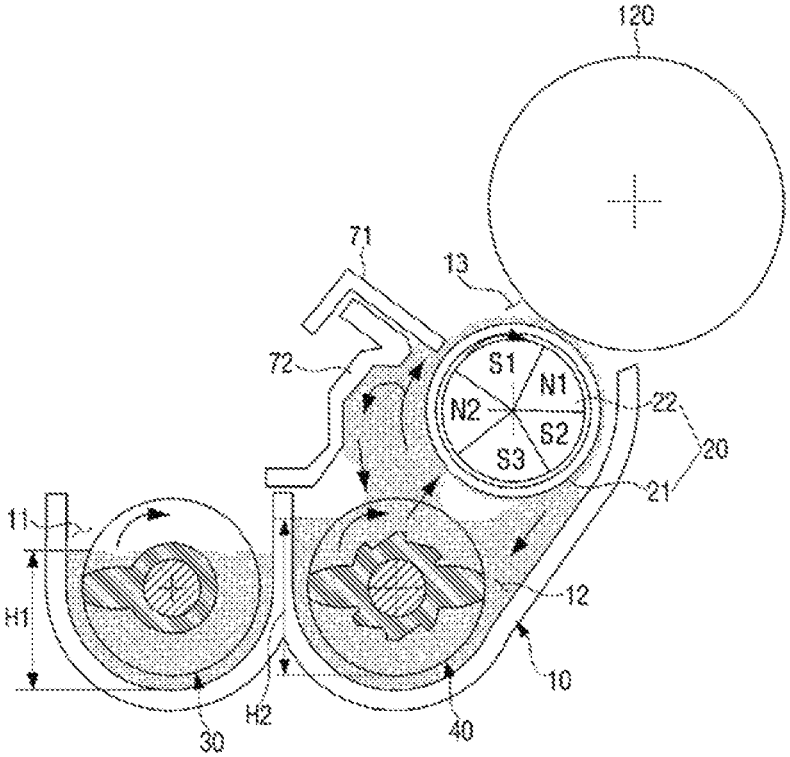
FIG. 11 is a cross-sectional view illustrating a flow of developer in a second developer area of a developing apparatus according to an embodiment of the present disclosure.

FIG. 11 is a cross-sectional view illustrating a flow of developer in a second developer area of a developing apparatus according to an embodiment of the present disclosure.

When developing an electrostatic latent image on the image carrier 120 by the developing roller 20 of the developing apparatus 1, the first mixing member 30 and the second mixing member 40 are rotated at the same speed. Since the second mixing member 40 includes the plurality of ribs 50, the conveying speed of the developer is lowered, and the mixability is enhanced. Accordingly, the height H2 of the developer in the second developer area 12 including the second mixing member 40 and the developing roller 20 becomes higher than the height H1 of the developer in the first developer area 11 including the first mixing member 30.

When the second mixing member 40 is rotated, the developer is moved from the second mixing member 40 to the catch pole S3 of the developing roller 20. The developer moved to the catch pole S3 is attached to the developing roller 20, and is moved to the regulating pole N2 by the rotation of the developing roller 20. While moving to the regulating pole N2, some of the developer is removed from the developing roller 20 by the second regulating member 72, is returned to the second mixing member 40, and is mixed again. The developer attached to the developing roller 20 passes by the first regulating member 71, and is moved to the image developing region 13 in which the main pole S1 is located. In the image developing region 13, toner of the developer is moved to the image carrier 120 so as to develop the electrostatic latent image formed on the image carrier 120. The developer having passed through the image developing region 13 passes by the conveying pole N1, and then is moved to the separating pole S2. The developer moved to the separating pole S2 is separated and dropped from the developing roller 20 by repulsion with the catch pole S3 having the same polarity as the separating pole S2. The dropped developer is mixed again by the second mixing member 40.

As described above, when the second mixing member 40 is provided with the plurality of ribs 50, the height H2 of the developer in the second developer area 12 in which the second mixing member 40 and the developing roller 20 are disposed may be increased so that the developer supply to the developing roller 20 may be stabilized to form an image with a uniform concentration. Accordingly, image defects such as auger mark that occurs when the height H2 of the developer in the second developer area 12 is low do not occur. Also, the mixability of the developer is improved in the second developer area 12 by the plurality of ribs 50 formed on the second mixing member 40 so that the charging amount of the developer may be stabilized. Accordingly, it is possible to prevent occurrence of toner scattering.

Hereinafter, a case in which the height H2 of the developer in the second developer area 12 is not appropriate will be described with reference to FIGS. 12*a* and 12*b*.

Figure 12A:
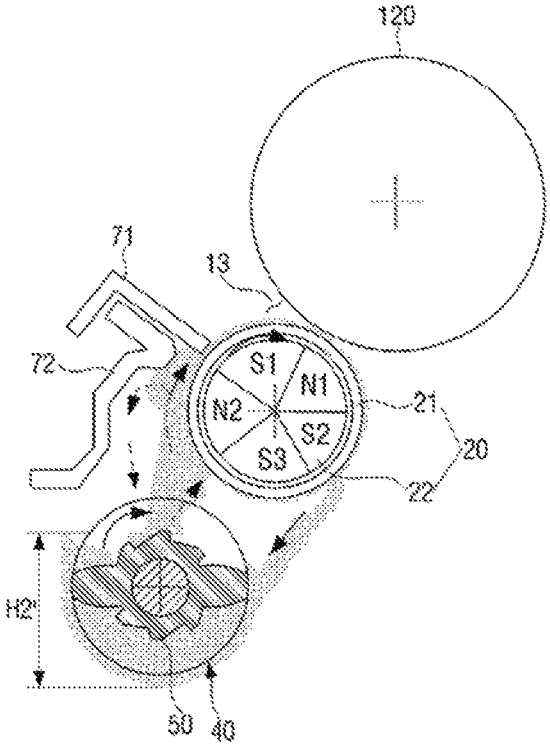
FIGS. 12*a* and 12*b* are cross-sectional views illustrating a flow of developer when a height of developer is low in a second developer area of a developing apparatus and when the height of developer is high in the second developer area of the developing apparatus.

As illustrated in FIG. 12*a*, when the height H2' of the developer in the second developer area 12 is low, the amount of the developer that is moved to the catch pole S3 of the developing roller 20 is not stabilized. Thus, the amount of the developer that is moved to the regulating pole N2 is also small so that density difference of the developer may easily occur. At this time, the image defect called as auger mark may easily occur.

Figure 12B:
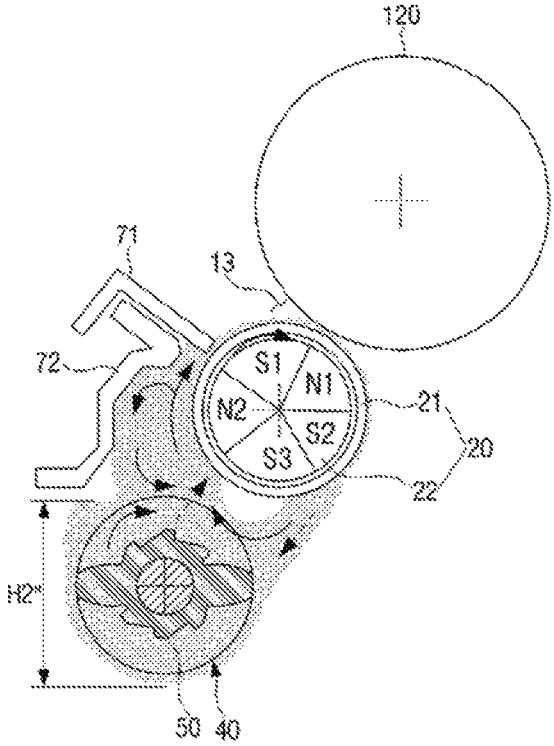

Contrary, when the height H2" of the developer in the second developer area 12 is too high as illustrated in FIG. 12*b*, before the catch pole S3 of the developing roller 20 receives the developer from the second mixing member 40, the developer that is removed and dropped by the second regulating member 72 or the developer that is separated from the developing roller 20 by the separating pole S2 may be easily attached to the catch pole S3. Specifically, if the developer the toner concentration of which is decreased after developed in the image developing region 13 is separated and dropped in the separating pole S2, and is reattached to the catch pole S3 before being mixed by the second mixing member 40, the developer with the low toner concentration is circulated along the developing roller 20. In such a case, the concentration of the printed image is reduced.

Accordingly, to remain the height H2 of the developer in the second developer area 12 in which the second mixing member 40 is disposed constant is important to the developing apparatus 1, in particular, to the auto developer refill developing apparatus. When the second mixing member 40 is provided with the plurality of ribs 50 as the developing apparatus 1 according to the present disclosure, the height H2 of the developer in the second developer area 12 may be kept more constant than the conventional developing apparatus.

Inventors experimented how much the amount of developer changes when the developing apparatus 1 including the second mixing member 40 with the plurality of ribs 50 according to the present disclosure operates at the maximum speed and at the half speed. The plurality of ribs 50 of the second mixing member 40 was tested with respect to three types of cross-sectional shapes, that is, the rib 55 of a rectangular cross-section (A type) as illustrated in FIG. 9*b*, the rib 50 of a trapezoidal cross-section (B type) as illustrated in FIG. 7*c*, and the rib 50-2 of a trapezoidal cross-section (C type) having a slope opposite to the cross-section of FIG. 7*c* as illustrated in FIG. 8*d*. At this time, the cross-sectional areas of the ribs 55, 50, and 50-2 of all shapes are identical.

In this experiment, after new developer of 400 g is put into the developing apparatus 1 including the second mixing member 40 having one of three types of plurality of ribs 55, 50, and 50-2 as described above, and the developing apparatus 1 is driven at the maximum speed for 60 minutes, the amount of developer of the developing apparatus 1 is checked. In the same state, the developing apparatus 1 is driven at the half speed, and the amount of the developer of the developing apparatus 1 is checked after 30 minutes.

Specific experiment conditions are as follows.

Initial toner density; 7%

Initial charge amount; −50 μC/g

Toner; 6.7 μm polymerized toner.

Carrier; 38 μm

Maximum speed; 170.7 mm/sec

Half speed; 70.5 mm/sec

The experimental results are as follows.

TABLE 1

| | A type | B type | C type |
|---|---|---|---|
| Amount of developer at a maximum speed (g) | 367.7 | 371.9 | 368.5 |
| Amount of developer at a half speed (g) | 372.5 | 376.3 | 379.2 |
| Difference between the amount of developer | 4.8 | 4.4 | 10.7 |

Referring to Table 1, in the experimental results at the maximum speed, it is checked that the amount of the developer of the developing apparatus 1 having the second mixing member 40 using the B type of ribs 50 is the largest. This is because when the number of rotations of the second mixing member 40 is high, the effect that the side surface 52 of the rib 50 of the downstream side of the rotational direction of the second mixing member 40 bounces the developer is large. When the developer bouncing effect is large, the mixability of the developer is enhanced, but the conveyability is lowered. When the conveyability of the developer is lowered, the height H2 of the developer in the second developer area 12 is increased, but the height H1 of the developer in the first developer area 11 is relatively reduced. Accordingly, because the discharge of the developer through the developer discharge port 62 is difficult, the amount of the developer is increased.

In the maximum speed experiment, the amount of developer of the developing apparatus 1 having the second mixing member 40 using the A type of ribs 55 is the lowest. This is considered to be because when the number of rotations of the second agitating member 40 is high, the developer between the rib 55 and the rib 55 is difficult to be replaced so that the developer bouncing effect is small. When the bouncing effect is small, the mixability of the developer is lowered, but the conveyability is increased. When the conveyability of the developer is increased, the height H2 of the developer in the second developer area 12 is lowered, but the height H1 of the developer in the first developer area 11 is relatively increased. Accordingly, because the discharge of the developer through the developer discharge port 62 becomes easy, the amount of the developer is reduced.

In the maximum speed experiment, the developing apparatus 1 having the second mixing member 40 using the C type of ribs 55-2 has a middle amount of developer.

Referring again to Table 1, in the experimental results at the half speed, it is checked that the amount of developer of the developing apparatus 1 having the second mixing member 40 using the C type of ribs 50-2 is the largest. The C type of rib 50-2 has a weak force for pumping the developer, but the C type of rib 50-2 has a force to push up the developer toward the developing roller 20. In this case, it is assumed that because the amount of developer transferred to the catch pole S3 of the developing roller 20 is increased, the height H2 of developer in the second developer area 12 is increased and the height H1 of the developer in the first developer area 11 is relatively decreased so that the discharge of the developer through the developer discharge port 62 becomes difficult.

In the half speed experiment, the amount of developer of the developing apparatus 1 having the second mixing member 40 using the A type of ribs 55 is the lowest. This is presumably because the A type of rib 55 can pump the developer in the rotational direction, but the pumping effect may be reduced due to the insufficient replacement of the developer between the rib and the rib. In this case, because the conveyability of the developer is increased than the mixability, the height H2 of developer in the second developer area 12 is decreased, and the height H1 of developer in the first developer area 11 is relatively increased so that the discharge of the developer through the developer discharge port 62 becomes easier.

In the medium speed experiment, it is assumed that because the developer bouncing effect remains, the developing apparatus 1 having the second mixing member 40 using the B type of ribs 50 has the amount of developer larger than the developing apparatus 1 using the A type of ribs 55.

It can be seen from the above-described experimental results that the ribs 50 having the B type of cross-section among the ribs 55, 50, and 50-2 having three types of cross-sections has the smallest difference in the amount of developer between the maximum speed and the half speed, that is, 4.4 g. In other words, it can be seen that the change in the amount of developer of the developing apparatus 1 having the ribs 50 of the B type of cross-section is the smallest.

Accordingly, in order to render the change in the amount of developer to be smallest when changing the speed of the developing apparatus 1 between the maximum speed and the half speed, the ribs may be formed in the B type of ribs 50 having an inclined plane 51 upwardly inclined towards the downstream side of the rotational direction of the second mixing member 40.

Hereinafter, an image forming apparatus including a developing apparatus according to an embodiment of the present disclosure will be described with reference to FIG. 13.

Figure 13:
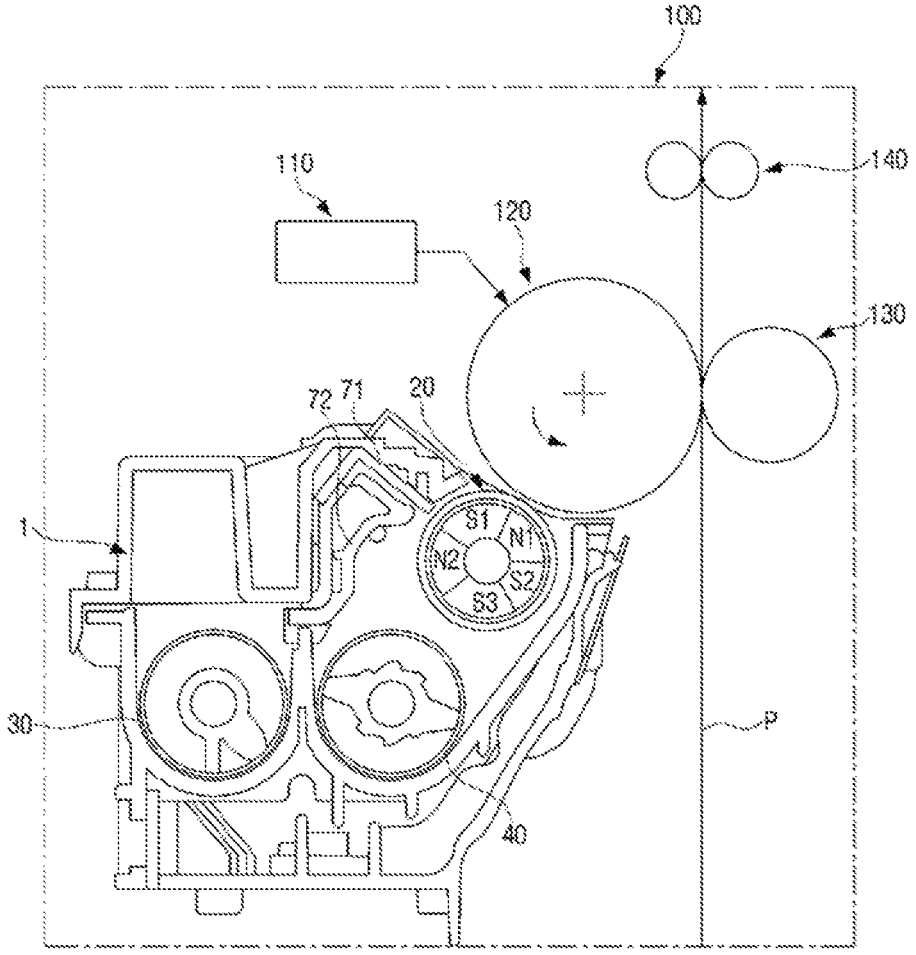
FIG. 13 is a view schematically illustrating an image forming apparatus having a developing apparatus according to an embodiment of the present disclosure.

FIG. 13 is a view schematically illustrating an image forming apparatus having a developing apparatus according to an embodiment of the present disclosure. In FIG. 13, parts that perform an operation for forming an image on a print medium are conceptually illustrated, and a print medium feeding unit, a print medium discharging unit, and the like that are included in the general image forming apparatus are omitted.

Referring to FIG. 13, the image forming apparatus 100 may include an exposure unit 110 for emitting light corresponding to predetermined printing data, an image carrier 120 on which an electrostatic latent image is formed by the light emitted from the exposure unit 110, a developing apparatus 1 for developing the electrostatic latent image formed on the image carrier 120 into a developer image, a transfer roller 130 for transferring the developer image formed on the image carrier 120 onto a print medium P, and a fusing unit 140 for fusing the transferred developer image on the print medium P. Structures and functions of the exposure unit 110, the image carrier 120, the transfer roller 130, and the fusing unit 140 are the same as or similar to those of the conventional image forming apparatus; therefore, detailed descriptions thereof are omitted. The developing apparatus 1 is the same as the developing apparatus 1 according to the above-described embodiment; therefore, a detailed description thereof is omitted.

When a print command is received, the exposure unit 110 emits light to form an electrostatic latent image corresponding to the printing data on the surface of the image carrier 120. At this time, the developing apparatus 1 causes developer in the second developer area 12 to be moved to the catch pole S3 of the developing roller 20 by rotating the first and second mixing members 30 and 40. The developer attached to the developing roller 20 is regulated by the first and second regulating members 71 and 72, and then is moved to the image developing region 13 that faces the image carrier 120. Toner is moved from the developer located at the image developing region 13 to the image carrier 120, thereby developing the electrostatic latent image into a developer image. The developer completing the development is dropped into the second developer area 12 by the separating pole S2 of the developing roller 20, and then is remixed by the second mixing member 40.

The developer image formed on the image carrier 120 is transferred onto the print medium P by the transfer roller 130. The developer image transferred onto the print medium P is fused to the print medium P while passing through the fusing unit 140. The print medium P the fusing of which is completed is discharged to the outside of the image forming apparatus 100 by the print medium discharging unit, so the printing is completed.

Hereinabove, although the exemplary embodiments of the present disclosure have been shown and described, it should be understood that the present disclosure is not limited to the disclosed embodiments and may be variously changed by those skilled in the art without departing from the spirit and the scope of the present disclosure. Therefore, the present disclosure should be construed as including all the changes, equivalents, and substitutions included in the spirit and scope of the present disclosure.

The invention claimed is:

1. A developing apparatus, comprising:

a developing roller;

a developing housing which rotatably supports the developing roller and to receive two-component developer;

a first mixing member disposed in the developing housing to mix the two-component developer; and a second mixing member disposed in the developing housing to be parallel to the first mixing member and adjacent to the developing roller, wherein the second mixing member includes:

a shaft having a circumferential surface, a spiral wing part formed along the shaft, and a plurality of ribs formed to protrude from the circumferential surface of the shaft and be aligned along the circumferential surface and encircling the circumferential surface of the shaft.

2. The developing apparatus of claim 1, wherein the plurality of ribs are formed at predetermined intervals.

3. The developing apparatus of claim 1, wherein each rib of the plurality of ribs is continuously formed in a longitudinal direction of the shaft.

4. The developing apparatus of claim 3, wherein a number of the plurality of ribs satisfies a following formula:

$$4 \leq n \leq 8$$

wherein, n is the number of the plurality of ribs.

5. The developing apparatus of claim 3, wherein the circumferential surface of the shaft is exposed between the plurality of ribs.

6. The developing apparatus of claim 1, wherein the first mixing member comprises a first shaft and a first spiral wing part formed along the first shaft, wherein each rib of the plurality of ribs satisfies a following formula, $$Di2+2h>Di1$$

where, Di1 is an inner diameter of the first mixing member being an outer diameter of the first shaft, Di2 is an inner diameter of the second mixing member being an outer diameter of the shaft, and h is a height of the plurality of ribs protruding from the shaft of the second mixing member.

7. The developing apparatus of claim 1, wherein each rib of the plurality of ribs satisfies a following formula, $$0.5\ \text{mm} \leq h \leq (Do2-Di2)/4\ \text{mm}$$

wherein, Do2 is an outer diameter of the second mixing member being an outer diameter of the spiral wing part formed along the shaft, Di2 is an inner diameter of the second mixing member being an outer diameter of the shaft, and h is a height of the plurality of ribs protruding from the shaft of the second mixing member.

8. The developing apparatus of claim 1, wherein each rib of the plurality of ribs comprises an inclined plane, and a height of the inclined plane of a downstream side based on a rotational direction of the second mixing member is higher than a height of the inclined plane of a upstream side.

9. The developing apparatus of claim 8, wherein each rib of the plurality of ribs further comprises a vertical plane vertically extended from the circumferential surface of the shaft, and a connecting plane connecting the vertical plane and the inclined plane.

10. The developing apparatus of claim 8, wherein the inclined plane of each rib of the plurality of ribs comprises a concave groove or a convex protrusion.

11. The developing apparatus of claim 8, wherein the inclined plane of each rib of the plurality of ribs is formed in a concave curved line or a convex curved line.

12. The developing apparatus of claim 1, wherein each rib of the plurality of ribs is formed to have a cross-section shape of a rectangle, or a triangle, or a semicircle.

13. The developing apparatus of claim 1, wherein the developing housing is provided with a developer discharge port which is formed in a downstream of a developer conveying direction of the first mixing member and discharges an excess amount of the two-component developer outside the developing housing.

14. The developing apparatus of claim 13, wherein the developing housing is provided with a developer supply port which is formed in an upstream of the developer conveying direction of the first mixing member and supplies a new amount of the two-component developer to an inside of the developing housing.

15. An image forming apparatus, comprising:

an image carrier on which an electrostatic latent image is formed; and the developing apparatus of claim 1 to supply the two-component developer to the image carrier.

* * * * *